US006996929B1

(12) United States Patent
Greene, Jr. et al.

(10) Patent No.: US 6,996,929 B1
(45) Date of Patent: Feb. 14, 2006

(54) FOLDING SIGN SYSTEM

(75) Inventors: Philip E. Greene, Jr., Penn Hills, PA (US); Jamie L. Zarzeczny, Latrobe, PA (US)

(73) Assignee: Matthews Resources, Inc., Wilmington, DE (US)

( * ) Notice: Subject to any disclaimer, the term of this patent is extended or adjusted under 35 U.S.C. 154(b) by 126 days.

(21) Appl. No.: 10/788,014

(22) Filed: Feb. 26, 2004

(51) Int. Cl.
*G09F 7/22* (2006.01)

(52) U.S. Cl. ..... 40/617; 40/606.08; 40/606.14; 40/606.01; 40/611.01; 160/368.1

(58) Field of Classification Search ..... 40/601, 40/604, 603, 606.08, 606.14, 617, 606.01, 40/611.01, 492; 160/327, 330, 333, 336, 160/338, 349.1, 387, 354, 368.1
See application file for complete search history.

(56) References Cited

U.S. PATENT DOCUMENTS

| | | | | |
|---|---|---|---|---|
| 733,137 | A * | 7/1903 | Bullard | 40/604 |
| 798,660 | A * | 9/1905 | Carrier | 40/604 |
| 1,960,095 | A * | 5/1934 | Tonnesen | 38/102 |
| 2,074,928 | A * | 3/1937 | Miller | 160/348 |
| 3,824,725 | A * | 7/1974 | Friedrichsen | 40/604 |
| 4,798,013 | A | 1/1989 | Sainato | |
| 4,909,299 | A * | 3/1990 | Bussert | 160/354 |
| 5,718,072 | A | 2/1998 | Garfinkle | |
| 6,003,697 | A * | 12/1999 | Ferchat et al. | 211/189 |
| 6,434,871 | B1 | 8/2002 | Conway | |
| 6,470,611 | B1 * | 10/2002 | Conway et al. | 40/606.14 |
| 6,665,969 | B1 | 12/2003 | Conway | |
| 2003/0230016 | A1 | 12/2003 | Padiak | |

* cited by examiner

*Primary Examiner*—Gary C. Hoge
(74) *Attorney, Agent, or Firm*—R. S. Lombard

(57) ABSTRACT

A sign system particularly useful for point of purchase displays is provided. The sign system includes an elongated trough for carrying one or more folding sign members. The trough is provided with a slot which because of its dimensions allows a media portion of the sign member to pass through the slot and hang below the trough member while the top of the sign member is retained in the trough. In one embodiment the elongated troughs are carried by vertical supports which attach to an existing shelving system. Other embodiments are disclosed for supporting the elongated trough. The folding sign members have a display position for displaying any messages or graphics carried by the sign member, and a shelving accessibility position in which the sign member may be folded allowing access to any shelving hidden by the sign members while the sign member is retained in the folded position by the trough.

18 Claims, 8 Drawing Sheets

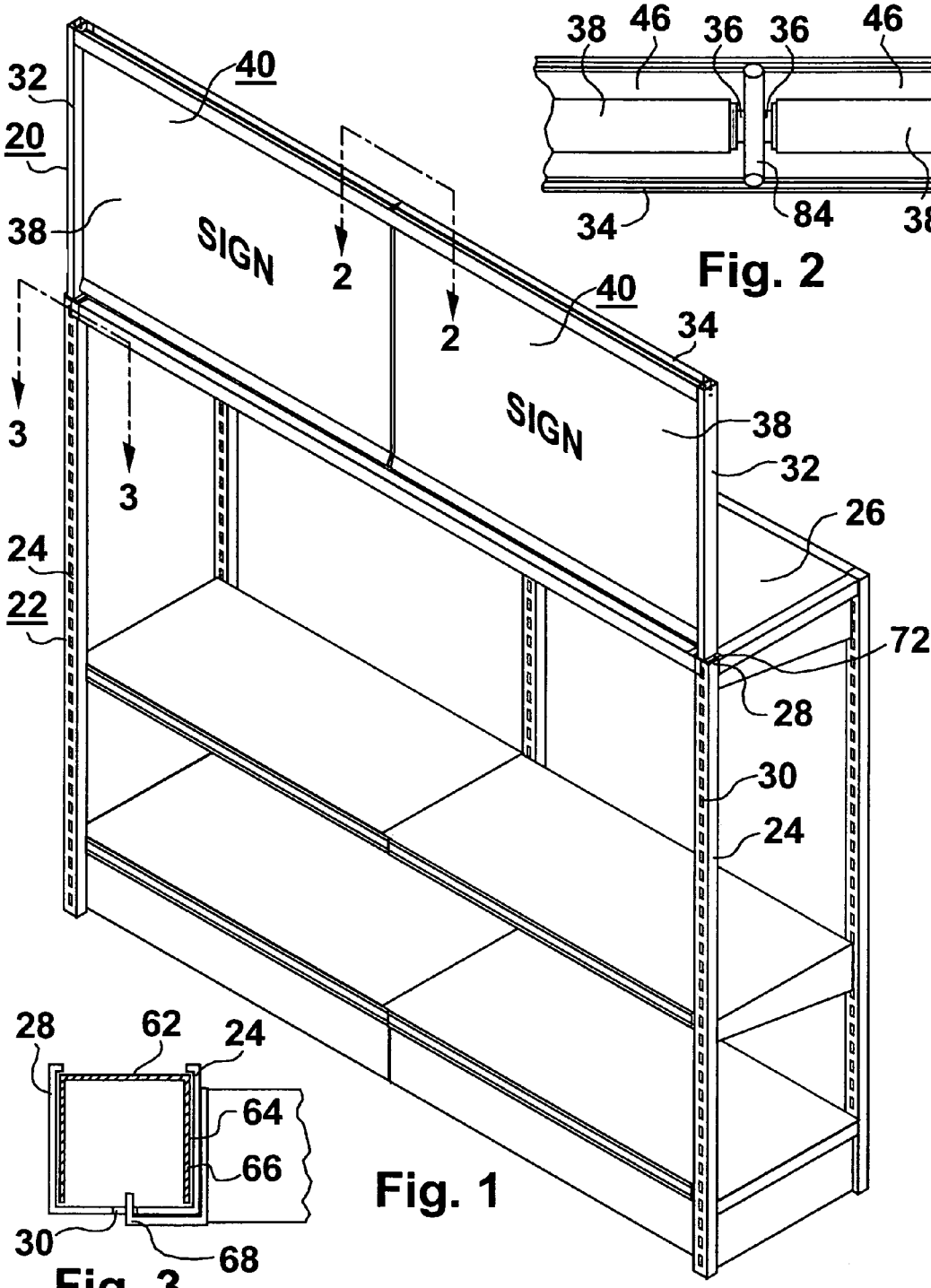
Fig. 1
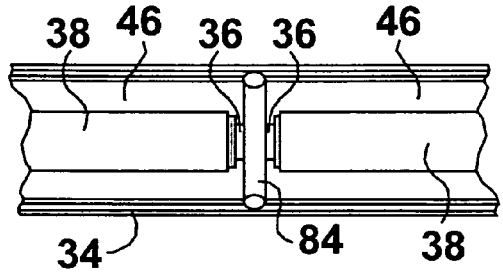
Fig. 2
Fig. 3

FOLDING SIGN SYSTEM

BACKGROUND OF THE INVENTION

The present invention relates to a sign system, and, in particular, to a sign system including a sign member useful in point of purchase advertising that may be mounted overhead on existing shelving, for example. The sign member of the present invention may be folded for easy access to goods stored behind the sign member of the shelving.

Various sign systems attachable to shelving have been disclosed in the past, such as U.S. Pat. No. 4,798,013, dated Jan. 17, 1989, issued to Anthony Sainato, discloses a header sign assembly for product merchandising displays. The mounting assembly includes at least one header sign holder and mounting apparatus to mount the sign holder to pegboard or a shelf.

Another such sign system is disclosed in U.S. Pat. No. 5,718,072, dated Feb. 17, 1998, issued to Benjamin L. Garfinkle. The Garfinkle patent discloses a sign system which utilizes one or more rail sections for holding a plurality of sign holders above items displayed in supermarkets and the like.

In U.S. Pat. No. 6,434,871, issued to Thomas M. Conway, dated Aug. 20, 2002, is disclosed a mounting system for mounting a sign, such as, a sheet or panel to a horizontal shelf in one embodiment. Apparatus is disclosed for permitting the sign to be swung outwardly from a shelf to gain access to any items stored on the shelf. In another embodiment, a sign or display portion is mounted to the top of shelving partition walls which include support posts. Brackets are included which are inserted in the tops of the support posts which support the sign in fixed position.

Another such sign system is disclosed in U.S. Pat. application publication No. 2003/0230016, published Dec. 18, 2003, by Scott Padiak, et. al. The Padiak publication disclosed a display sign which can be moved for access behind where the display sign had been and which may be restored to the original position. The Padiak device generally utilized cables and guides to allow the sign to move.

And yet still another such sign system is disclosed in U.S. Pat. No. 6,665,969, issued to Thomas M. Conway, dated Dec. 23, 2003. This patent discloses a sign mounting system for at least two adjacent sign portions which together constitute a single sign. Apparatus is disclosed for attachment to existing shelving and provide means for the sign portions to be swung open for access to any items stored on a shelf behind a sign portion.

Problems may arise from a ease of access standpoint with some of the prior art assemblies which utilize apparently rigid sign portions which swing open to gain access to items stores on a shelf hidden by the sign portion. Often access to items stored on a shelf behind such a sign assembly are elevated beyond a person's reach and the use of a ladder or other similar device is necessary in order to reach the item which may be quite cumbersome or heavy. A sign portion that is required to swing substantially in a horizontal direction away from the elevated shelf may in some cases present difficulty for the person on the ladder, or other similar device. The person attempting to swing the sign portion open to reach the items, may be required to lean, or move backwards, away from shelving to "open" the sign portion possibly putting himself in a more precarious position.

Also, another drawback of the prior art assemblies is their apparent relative complexity.

SUMMARY OF THE INVENTION

The present invention provides a folding sign system used in conjunction with existing shelving structures for point of purchase advertising, such as, used in department stores, food stores, building supply stores, and the like. The folding sign system of the present invention, in one embodiment, attaches to an existing shelving system, such as an H-frame type or similar shelving system. Typically, such a shelving system includes vertical hollow uprights at the front of the shelving system. The shelving system includes shelving near the tops of the vertical uprights.

The folding sign system in the first embodiment includes at least two vertical supports attached to and supported by the vertical hollow uprights. At least one elongated trough is supported substantially horizontally between the vertical supports near the tops of the supports. The elongated trough has a longitudinal slot near the bottom of the trough of predetermined dimensions.

At least one folding sign member is carried by the trough. The folding sign member has a display position with the sign member fully extended, and, a shelving accessibility position with said sign member folded. The folding sign member has a folding media portion sized to pass through the slot in the trough and to hang below trough in the display position.

The folding sign member has an integral top transverse sleeve at the top of the sign member. The folding sign member also has an integral bottom transverse sleeve at the bottom of the sign member adjacent to the media portion. At least one top elongated member is at least partially housed within the top sleeve of the sign member. The top elongated member is sized to provide lateral rigidity for the sign member and sized to prevent the top sleeve of the sign member from passing through the slot in the trough with the top elongated member in the operative position. The top transverse sleeve is housed within the trough. At least one bottom elongated member is at least partially housed within the bottom sleeve of the sign member. The bottom member is sized to provide lateral rigidity for the sign member and sized to fit within the trough when the sign member is in the shelving accessibility position. The bottom elongated member is of predetermined weight. The bottom sleeve of the sign member is also housed within the trough when the sign member is in the shelving accessibility position. The trough is of sufficient size to accommodate both the top sleeve and bottom sleeve of the sign member simultaneously when the sign is in the sign accessibility position.

Utilizing the present invention, when the sign member is fully extended in the display position, goods stored on the top shelving are hidden by the folding media portion of the sign member. When the sign member is folded in the shelving accessibility position and the bottom sleeve of the sign member is placed in the trough, access is provided to the stored goods on the top shelving.

Preferably, the longitudinal slot of the trough is sized to permit the folding media portion of the sign member to pass freely through it. Also, the top elongated member preferably has a minimum cross-sectional width greater than the width of the slot of the trough.

The folding sign system of the present invention may include a number of contiguous sign members which may be carried in a single trough or multiple adjacent troughs. The sign members in the display position together having the media portions of the sign members forming a banner.

The folding sign member of the present invention is desirably made of vinyl. Preferably, the bottom elongated member has a length equal to the width of the sign member.

Also, it is preferred that the top elongated member have a length at least as long as the width of the sign member.

Preferably, the bottom elongated member has a weight greater than the weight of the sign member so that when the sign member is in the shelving accessibility position the weight of the bottom elongated member while resting in the trough will maintain the sign member in a folded state.

Desirably, the top elongated member has a length at least as long as the width of the sign member. Also, the longitudinal slot of the trough should be of sufficient width to permit the bottom sleeve of the sign member, with the bottom elongated member removed, to pass through the slot. The bottom elongated member and the top elongated member may be tubular, for example. The trough preferably includes a sleeve contact portion which has a V-shaped cross-section.

The vertical supports of one embodiment of the present invention near the bottoms of the supports, each desirably further include an elongated upright insertion portion of predetermined dimensions. The elongated upright insertion portions wedge snugly within the interior of the tops of the vertical hollow uprights. This permits the vertical supports to be maintained in operative position by the vertical hollow uprights of the shelving system.

The vertical supports each preferably further include a lip portion extending perpendicularly outwardly from the vertical support. The lip portion is adjacent to the elongated upright insertion portion of the vertical supports. The lip portions maintain the vertical supports in position relative to the tops of the vertical hollow uprights of the shelving system. Also, desirably, the tops of the vertical supports each have threaded apertures passing through the tops in predetermined position. The trough member preferably near its ends has first apertures in operative alignment with the threaded apertures of the vertical supports. Bolt members pass through the first apertures and operatively engage the threaded apertures.

In a second embodiment, the folding sign system of the present invention is used in conjunction with an existing shelving system which includes at least one horizontal member and shelving mounted below the horizontal member. The second embodiment of the present invention utilizes the trough of the first embodiment with the exception that the trough includes rearwardly extending tab members attached to the trough. The tab members include openings therethrough. Fastener members pass through the tab members and are attached to the horizontal member near the front of the member. The vertical supports of the first embodiment are not necessary in the second embodiment because of the direct attachment of the trough to the horizontal member. The other features of the second embodiment are the same as the first embodiment.

In a third embodiment of the present invention, a folding sign system is disclosed for hiding goods stored on a shelving system. The folding sign system in this embodiment is not attached to the shelving system, but the sign system includes an elongated trough which is suspended by a pair of cable members attached to an overhead anchor such as a ceiling, for example. This embodiment also utilizes the trough of the first embodiment but does not use the vertical supports. The attachment of the trough to the pair of cable members may be accomplished by the use of a pair of S-hooks. Each of the cable members at one end include a loop portion. The ends of the trough have first apertures therein. A first of the S-hook members near the upper portion operatively engages the loop portion of one of the cable members. The lower portion of first S-hook member operatively engages one end of the trough proximate one of the first apertures. The same also applies to the configuration utilizing the second of the S-hook members. The other features of the third embodiment are the same as the first embodiment.

BRIEF DESCRIPTION OF THE DRAWINGS

For a better understanding of the invention, reference may be had to the accompanying drawings exemplary of the invention in which:

FIG. 1 is a perspective view of the folding sign system of the first embodiment of the present invention mounted on a shelving system;

FIG. 2 is a sectional plan view taken along the line 2—2 of FIG. 1;

FIG. 3 is a cross-sectional view taken along the line 3—3 of FIG. 1;

BRIEF DESCRIPTION OF THE PREFERRED EMBODIMENTS

Figure 4:
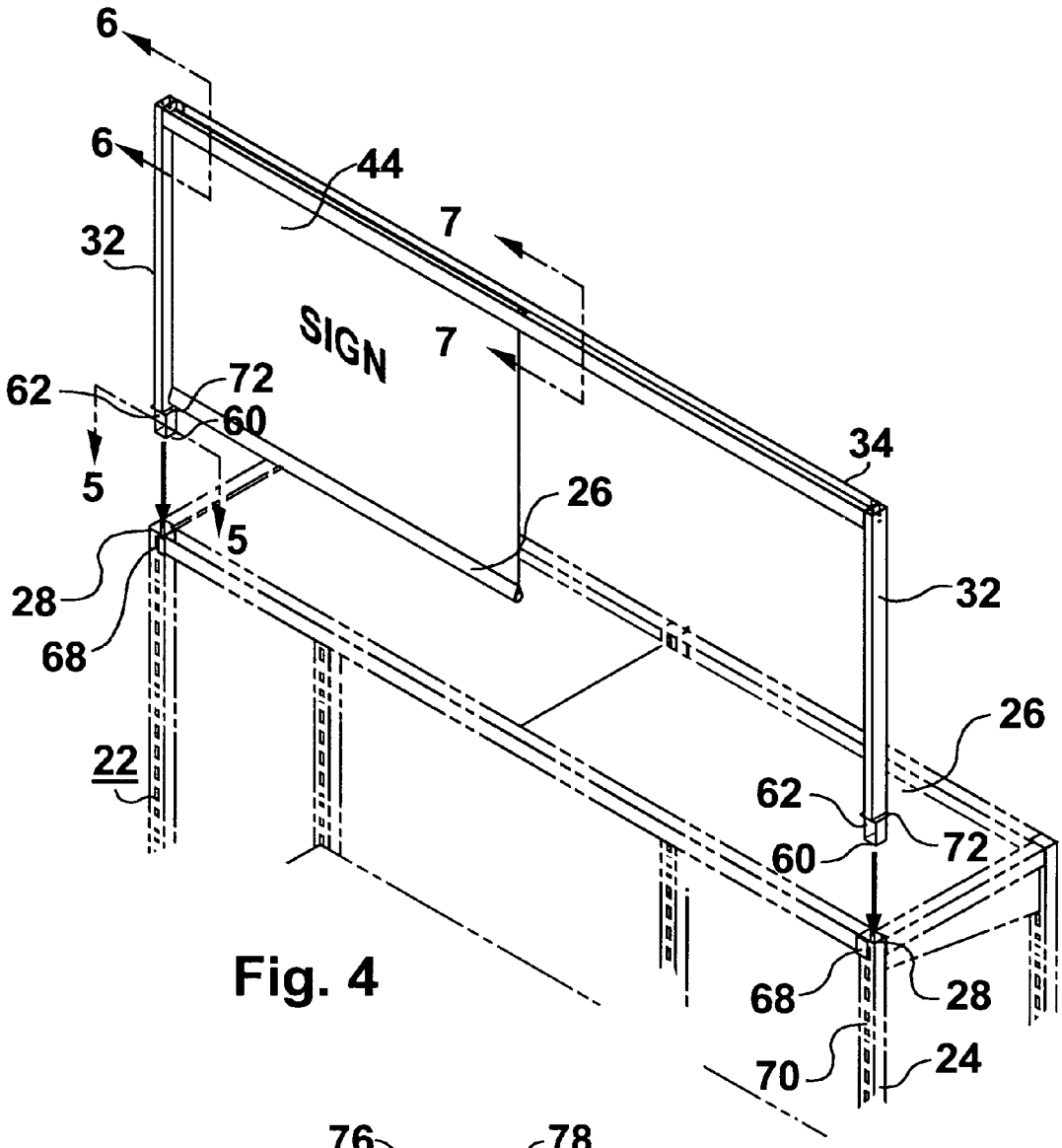
FIG. 4 is a perspective view of the present invention of the first embodiment prior to attachment to a shelving system.
Figure 5:
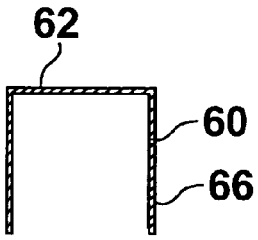
FIG. 5 is a cross-sectional view of the upright insertion portion of a vertical support taken along line 5—5 of FIG. 4.

With reference to FIGS. 1, 4, 10 and 14, the folding sign system 20 of the first embodiment of the present invention is depicted. The folding sign system 20 of the first embodiment is for attachment to an existing shelving system 22, such as, an H-frame shelving system commonly used for storage and display of goods on pallets, for example. The shelving system 22 for the first embodiment includes vertical hollow uprights 24 and shelving 26 near the tops 28 of the vertical uprights 24. Typically, the vertical hollow uprights 24 have a partial rectangular cross-section as shown in FIG. 3, for example, and have key hole shaped openings 30 for mounting the shelving 26 and other components as is known in the art.

Figure 14:
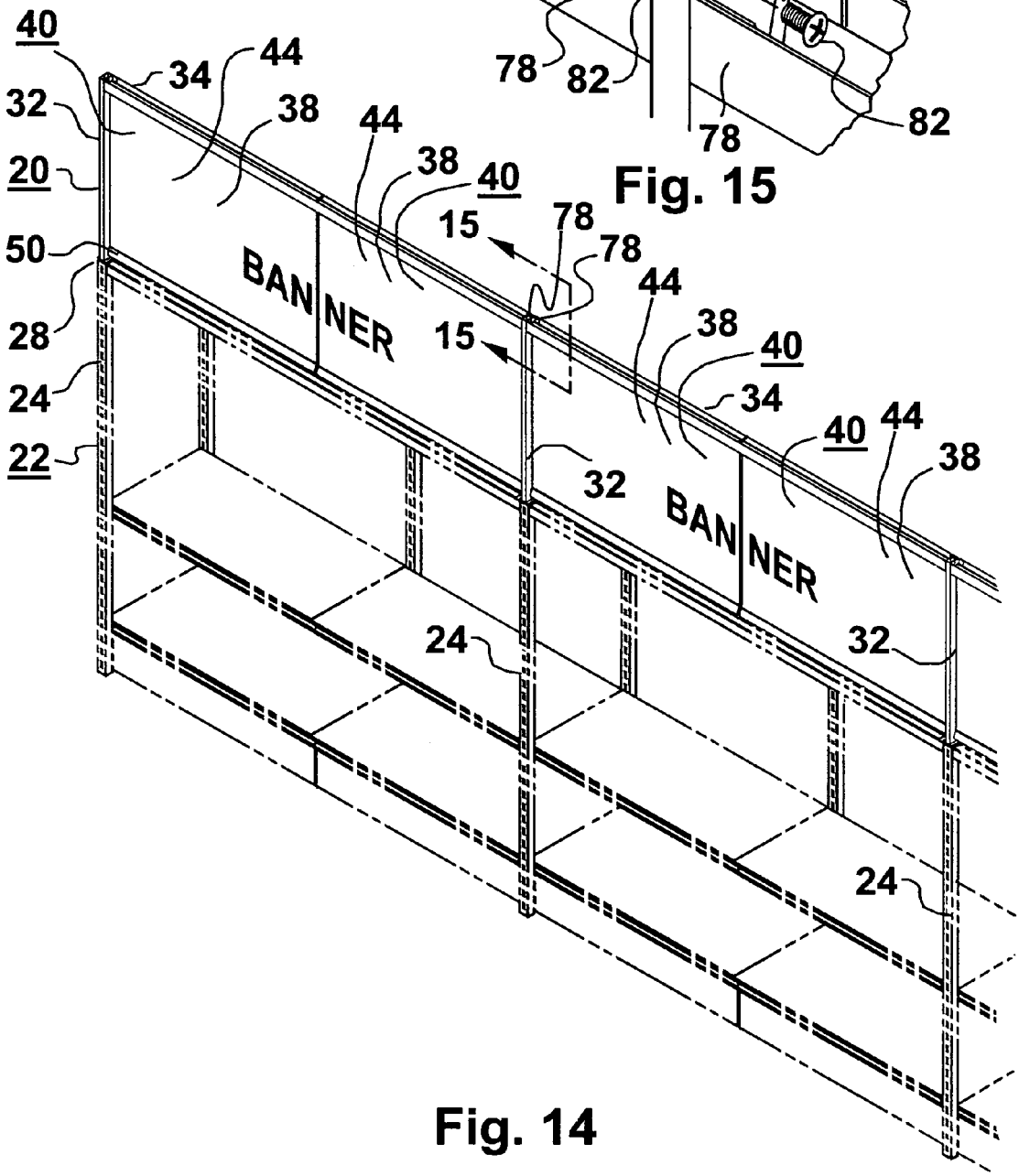
FIG. 14 is a perspective view of the first embodiment of the present invention in a multiple trough configuration.

As shown in FIGS. 1, 4, 8, 10 and 14, for example, the folding sign system 20 of the first embodiment of the present invention includes at least two vertical supports 32 and, as shown in FIG. 14, may include three or more vertical supports 32. With references to FIGS. 1 and 4, it can be seen that the vertical supports 32 are aligned with the hollow uprights 24 and inserted partially into the uprights 24 thereby attaching the supports 32 to the uprights near the tops 28. The vertical supports 32 may be made of aluminum or steel, for example.

At least one elongated trough 34 is supported substantially horizontally between two vertical supports 32 near the tops 28 of the uprights 24. The trough 34 has a longitudinal slot 36 of predetermined dimensions extending about the length of the trough 34.

Figure 8:
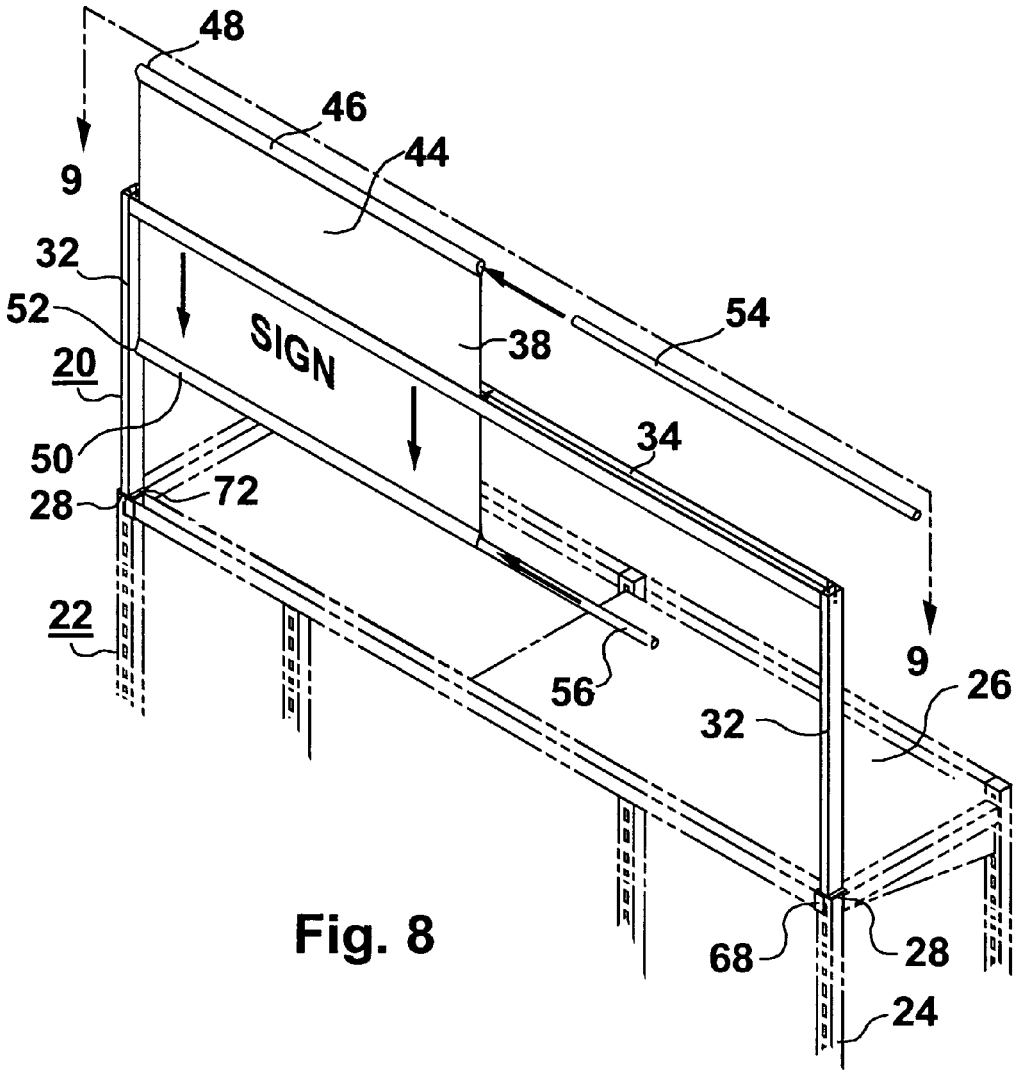
FIG. 8 is a perspective exploded view of the first embodiment of the present invention.
Figure 9:
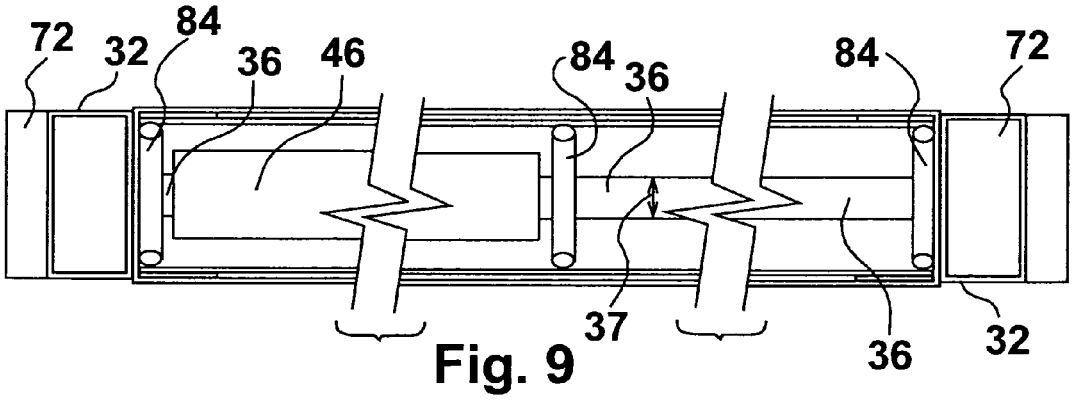
FIG. 9 is a plan view taken along line 9—9 of FIG. 8.
Figure 10:
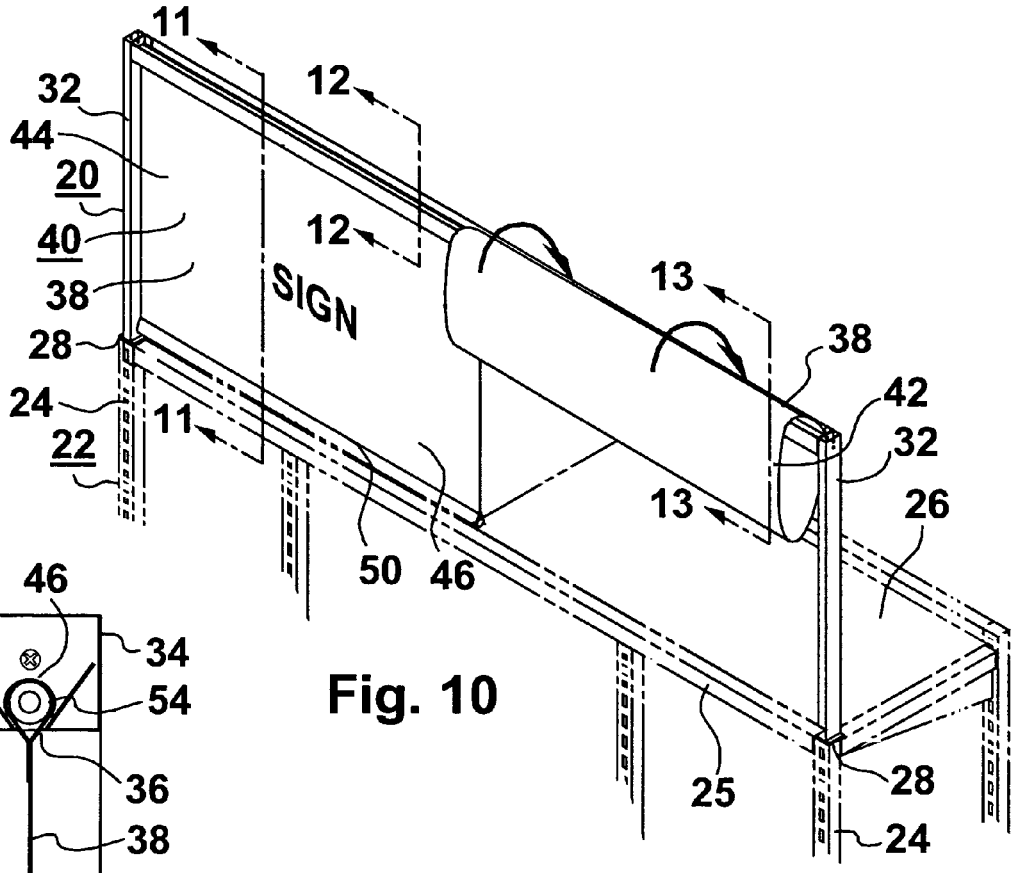
FIG. 10 is a plan view of the present invention showing sign members in the display position and in the shelving accessibility position.

At least one folding sign member 38 is carried by the trough 34 as shown in FIGS. 1, 2 and 8–13. Referring to FIG. 10, the sign member 38 has a display position 40 where the sign member 38 is fully extended, and a shelving accessibility position 42 when the sign member 38 is folded. The folding sign member 38 may be made of vinyl or any other material that folds, such as, cloth, canvas or burlap, for example. The folding sign member or members 38 has a folding media portion 44 sized to pass through the longitudinal slot 36 as shown in FIG. 8, for example, and hang below the trough 34 in the display position 40 as shown in FIG. 10, for example. The folding media portion 44 may carry on the front 46 of the media portion 44 any graphic or message desired as shown in FIGS. 1, 4, 8, 10 and 14, the words "SIGN" or "BANNER" have been used to connote this aspect.

The folding sign member 38 has an integral top transverse sleeve 46 near the top 48 of the sign member 38, as shown in FIGS. 8, 11–13, for example. The top sleeve 46 may be formed by folding the required amount of the sign member material back against itself and stitching in place or attaching by other means, such as stapling. The folding sign member 38 also has an integral bottom transverse sleeve 50 near the bottom 52 of the sign member 38 adjacent to the media portion 44. The integral bottom transverse sleeve 50 may be formed in the same manner as described for the top sleeve 46.

Figure 11:
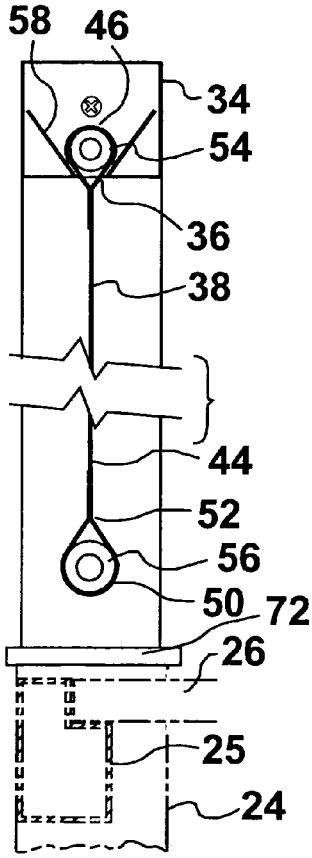
FIG. 11 is a cross-sectional view taken along the line 11—11 of FIG. 10.
Figure 12:
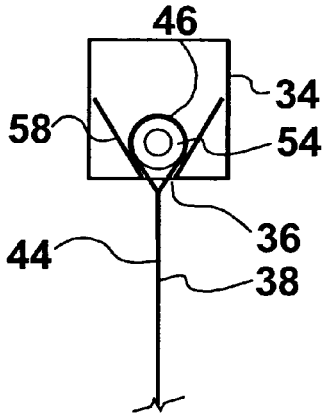
FIG. 12 is a cross-sectional view taken along the line 12—12 of FIG. 10.
Figure 13:
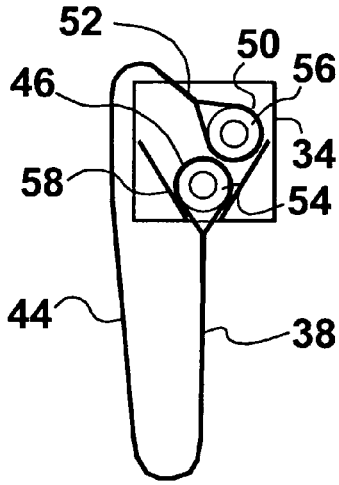
FIG. 13 is a cross-sectional view taken along the line 13—13 of FIG. 10.

At least one top elongated member 54 is at least partially housed within the top sleeve 45 of the sign member 38, as shown in FIGS. 8, 11–13, for example. The top elongated member 54 is sized to provide lateral rigidity for the sign member 38. As shown in FIG. 8, the top elongated member should preferably be at least as long as the width of the sign member 38. The top elongated, member 54 is also sized by having a minimum cross-sectional width greater than the width 37 of the slot 36 to prevent the top sleeve 46 of the sign member 38 from passing through the slot 36 when the top elongated member is in operative position as shown in FIGS. 9 and 12, for example. Also, preferably the top elongated member 54 should fit snugly when inserted in the top sleeve 46. In the operative position the top transverse sleeve 46 with the top elongated member 54 inserted in the sleeve 46 is housed within the trough 34, as shown in FIGS. 11–13.

At least one bottom elongated member 56 at least partially housed within the bottom sleeve 50 of the sign member 38, as shown in FIGS. 8, 11–13, for example. The bottom elongated member 56 is also sized to provide lateral rigidity to the sign member 38 and should also preferably be at least as long as the width of the sign member 38. The bottom elongated member 56 should also fit snugly when inserted in the bottom sleeve 50 to prevent it from falling out of the bottom sleeve 50. The bottom sleeve 50 is sized to fit within the trough 34 when the sign member 38 is in the shelving accessibility position 42, as shown in FIGS. 10 and 13, for example.

Utilizing the present invention, when the sign member 38 is fully extended in the display position 40, any goods stored on the top shelving 26 will be hidden by the media portion 44 of the sign member 38. Thus, in the display position 40 the invention acts to hide any stored goods behind the media portion 44 and, also the front 46 of the media portion 44 may carry any graphic or message desired for an effective point-of-purchase display. When access to the top shelving 26 is desired the sign member 38 is folded or lifted vertically upward by grasping the bottom sleeve 50 and the sleeve 50 is placed in the trough to be in the shelving accessibility position 42. In the shelving accessibility position 42 access is provided to the top shelving 26. It should be apparent that it is not necessary to swing the bottom sleeve 50 outwardly away from the front of the shelving, but the sleeve 50 may be lifted primarily vertically upwardly and placed in the trough 34 without requiring one to lean back away from the shelving 26 to any substantial degree while on a ladder, for example.

Preferably, the longitudinal slot 36 of the trough 34 is sized to permit the folding media portion 44 of the sign member to pass freely through the slot 36. Also, the top elongated member 54 should have a minimum cross-sectional width greater than the width of the slot 36 to prevent the top sleeve 46 from passing through the slot 36. Desirably, the bottom elongated member 56 has a weight greater than the weight of the sign member to ensure that when the sign member 38 is in the shelving accessibility position 42 and bottom sleeve 50 is resting in the trough 34 the sign member 38 will be maintained in the folded state unit until it desired to return the sign member 38 to the display position 40.

The folding sign system 20 in one configuration of the present invention may include a plurality of contiguous sign members 38, as shown in FIGS. 1, 10 and 14, for example. The contiguous sign members 38 maybe carried in a single trough 34 or multiple troughs 34, as shown in FIG. 14. The plurality of contiguous sign members 38 in the display position 40 having the media portions 44 together forming a continuous message, such as a banner.

Preferably, the longitudinal slot 36 of the trough 34 is of sufficient width 37 and length to permit the bottom sleeve 50 with the bottom elongated member 54 removed to pass through the slot 36. This enables the assembly and disassembly of the folding sign system 20 by permitting the bottom sleeve to be inserted down through the slot 36 during assembly before the bottom elongated member 56 is installed and to be pulled through the slot 36 after the bottom elongated member 56 is first removed for disassembly of the sign system 20.

Desirably, the trough 34 includes a V-shaped sleeve contact portion 58, as shown in FIGS. 7, 11–13 and 19, for example. The V-shaped sleeve aligns the top sleeve 46 of the sign member 38 with slot 36 by acting as a cradle, and it also maintains the bottom sleeve 50 when in the sign member 38 is in the accessibility position 42 as shown in FIG. 13. The top elongated member 54 and the bottom elongated member may be tubular, for example, and be made of metal piping, such as steel, for example. For example, a one-inch diameter steel tube with a 16 gauge wall may be used for members 54 and 56. The metal piping gives sufficient weight to maintain the bottom sleeve 56 in the trough 34 when the sign member 38 is in the shelving accessibility position 42.

The vertical supports 32 at the bottoms 60 thereof, preferably each include an elongated upright insertion portion 62 of predetermined dimensions so as to wedge snugly within the interior 64 of the top 28 of a vertical hollow upright 24, as shown in FIGS. 3 and 4, for example. This will maintain the vertical supports 32 in operative position by the uprights. Preferably, the elongated upright insertion portion 62 of the vertical supports 32 have a U-shaped cross-section 66, such as shown in FIGS. 3 and 4. It has been found with a shelving system having vertical hollow uprights 24 and shelving 26 that is held to the uprights by finger member 68 engaging the key hole shaped openings 30 on the front 70 of the uprights 24. The elongated upright insertion portion 62 is placed into the top 28 of the upright 24 so that the U-shaped cross-section 66 is situated as shown in FIG. 3. This provides maximum strength and rigidity for the sign system 20.

Preferably, the vertical supports 32 each include lip portions 72 extending about perpendicularly from the supports 32, adjacent to the elongated upright insertion portion 62, as shown in FIGS. 1, 4, 8 and 11, for example. The lip portions 72 maintain the vertical supports 32 in position relative to the tops 28 of the vertical hollow uprights 24. The lip portions 72 may be carried by only two opposite sides of the support 32, for example, as shown in FIG. 4, for example. The upright insertion portion 62 and the lip portions 72 may be welded to the vertical supports, for example.

Figure 6:
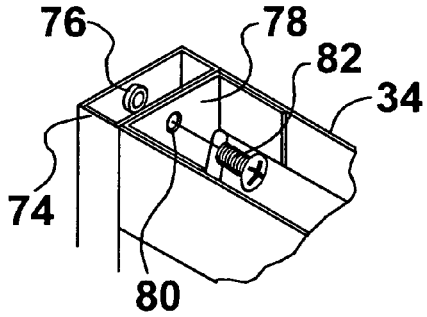
FIG. 6 is a perspective sectional view partially exploded taken along line 6—6 of FIG. 4.
Figure 7:
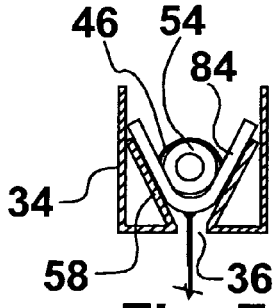
FIG. 7 is a cross-sectional view taken along the line 7—7 of FIG. 4.

Referring to FIG. 6, the tops 74 vertical supports 24 each have threaded apertures 76. The trough 34 at its ends 78 has first apertures 80 in operative alignment with the threaded apertures 76 of the vertical supports 32, screws 82 pass through the first apertures 80 and engage threaded apertures 76. Of course, the trough 34 may be attached to the vertical supports by other means such as welding, for example.

Figure 15:
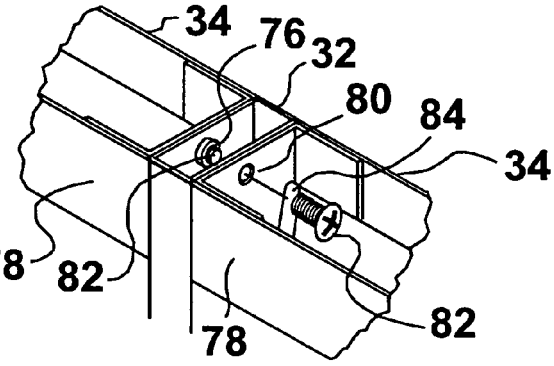
FIG. 15 is perspective sectional view partially exploded taken along the line 15—15 of FIG. 14.

The trough 34 may be made in any length desired such as about four feet or eight feet in length depending on the distance between the aligned pair of uprights 24. The trough 34 may carry one or more sign members 38 as shown in FIGS. 10 and 14. The trough 34 may be made of 16 gauge steel, for example. With reference to FIG. 9, it has been found desirable to include braces 84, which may be welded to the trough 34 between the sign members 38 and at the ends 78 of the trough 34 to provide strength for the trough 34. The brace 84 may be steel rod for example. Also, as shown in FIG. 14. A vertical support 32 positioned between two troughs 34 may be used to support the ends 78 of two troughs 34. A shown in FIG. 15, screws 82 pass trough first apertures 80 in the troughs 34 and engage threaded apertures 76.

Figure 16:
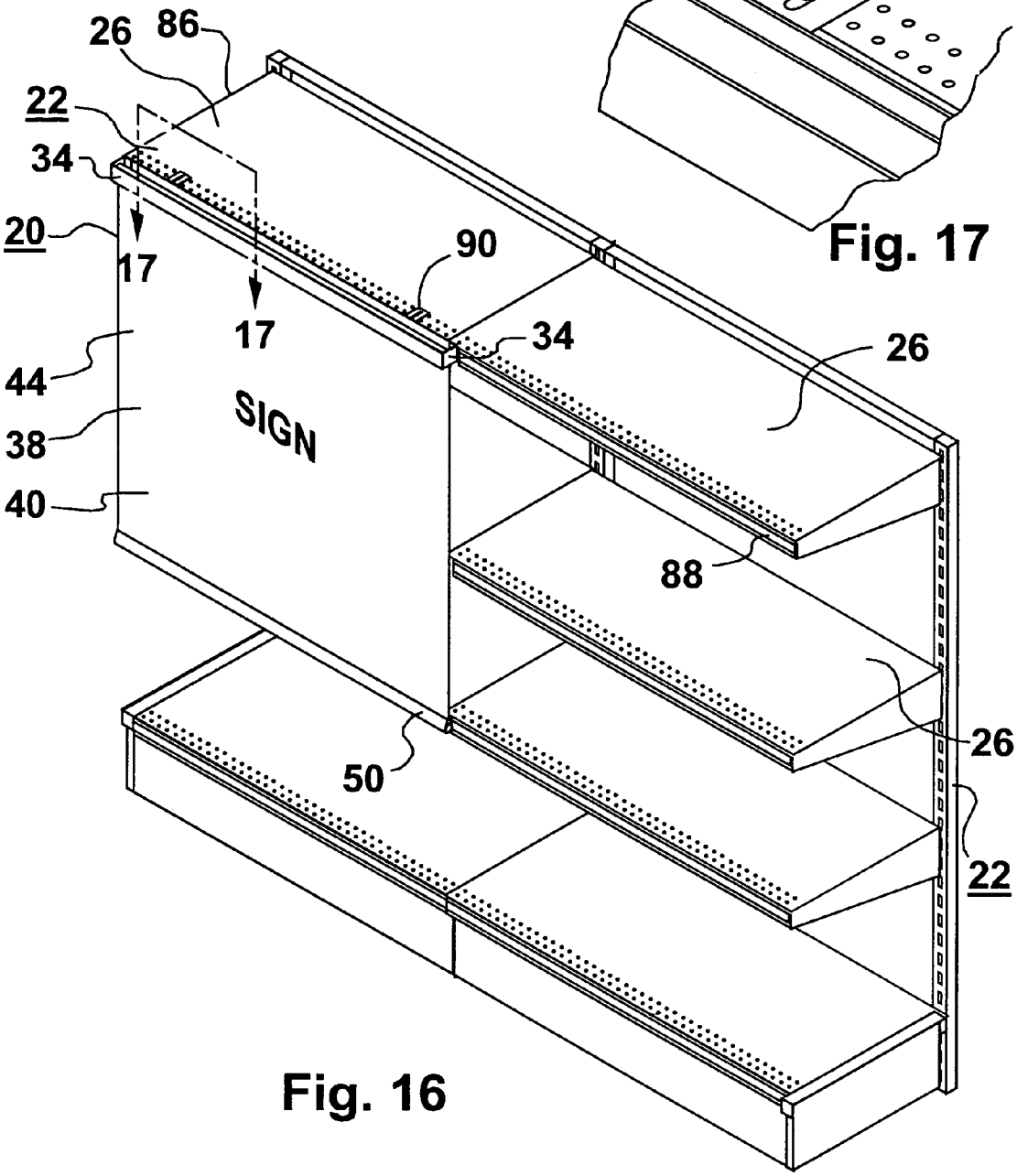
FIG. 16 is a perspective view of the second embodiment of the present invention with the sign member in the display position.
Figure 18:
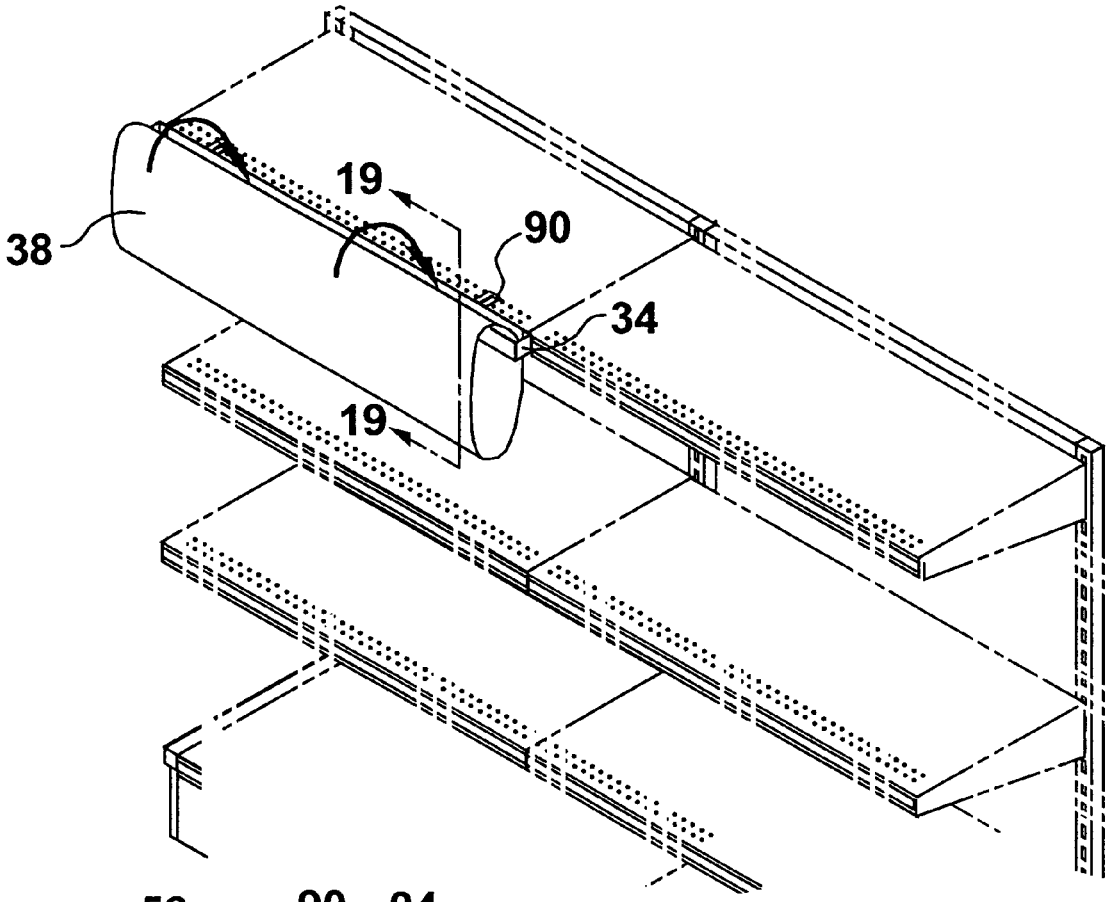
FIG. 18 is a perspective view of the second embodiment of the present invention showing the sign member in the shelving accessibility position.
Figure 19:
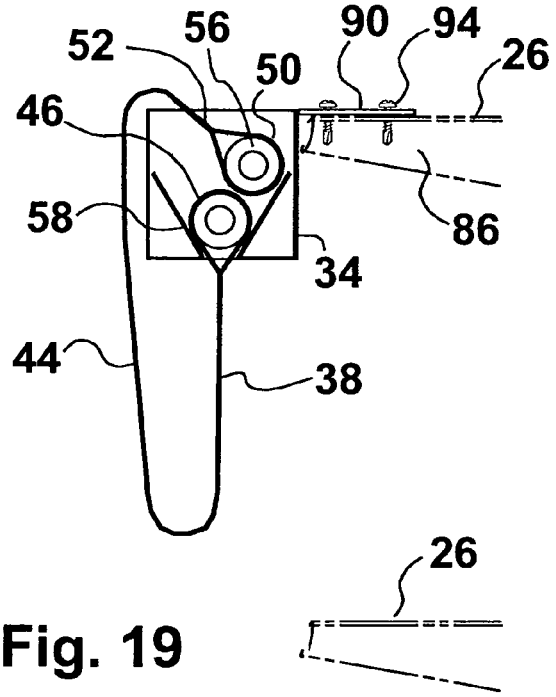
FIG. 19 is cross-sectional view taken along line 19—19 of FIG. 18; and, FIG. 20 is a perspective view of the third embodiment of the present invention.

A second embodiment of the present invention is shown in FIGS. 16–19. In this embodiment and the following embodiment the same numerals are used to denote like components described for the first embodiment. The folding sign system 20 of the second embodiment is intended for direct attachment to a shelving system 22 without the use of the vertical supports 32 of the prior embodiment. Very often a shelving system is not constructed with shelving 26 as described for the first embodiment, that is, with shelving attached near the tops 28 of uprights 24 as shown in FIG. 1, but has shelving 26 well below the tops of uprights 24 or does not have uprights near the front of the shelving 26 such as with a gondola shelving system 22 shown in FIG. 16. For purposes of the second embodiment, the shelving system 22 includes at least one horizontal member 86 near the front 88 of the shelving system 22 which as shown in FIG. 16 may be shelving 26 or a horizontal beam, not shown, for example.

Figure 17:
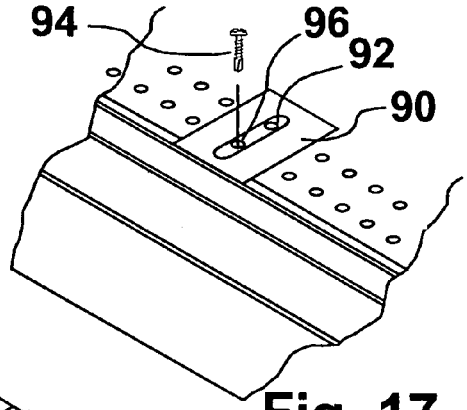
FIG. 17 is a perspective sectional view partially exploded taken along the line 17—17 of FIG. 16.

For the second embodiment the trough 34 of the first embodiment is modified by including rearwardly extending tab members 90 affixed to the trough 34, as shown in FIGS. 16–19. The tab members 90 have openings 92 as shown in FIG. 17. Fastener members 94 pass through the openings 92 and are affixed to the horizontal member 86, that is, shelving 26 by engaging second apertures 96. The fastener members 94 may be self threading fasteners, for example. The tab members 90 may be attached to the trough by welding for example. The trough 34 and tab members 90 may be made of 16 gauge steel, for example. The sign member 38, top and bottom elongated members 54 and 56, are as described for the first embodiment as shown in FIGS. 16–19. Although the sign system 20 is shown in FIG. 16 being attached to top shelving 26, it may be attached to lower shelving depending where goods are desired to be hidden and sign members 38 utilized with graphics and messages carried on the media portions 40 thereof.

The third embodiment of the present invention discloses a folding sign system 20 for hiding goods stores on a shelving system 22 and conveying messages or graphics on the sign members 38. The third embodiment of the invention varies from the first embodiment in that it does not require any physical attachment to the shelving system 22, but is simply attached to an overhead anchor 96, which may be a ceiling for example, see FIG. 20. Therefore, this embodiment also does not require the vertical supports 32 of the first embodiment. The sign system may be positioned in front of the shelving system 22 such that the sign member 38 will hang in front of the shelving 26 where goods are desired to be hidden. The folding sign system 20 also includes a pair of cable members 98. Each cable member 98 is affixed at one end 100 thereof in supportive relationship with the trough 34 near the ends 78 of the trough 34. The cable members 98 are attached at the other end 102 to the overhead anchor 96. The sign members 38, trough 34, top and bottom elongated members 54 and 56 are as described for the first embodiment as shown in FIGS. 16–19.

Figure 20:
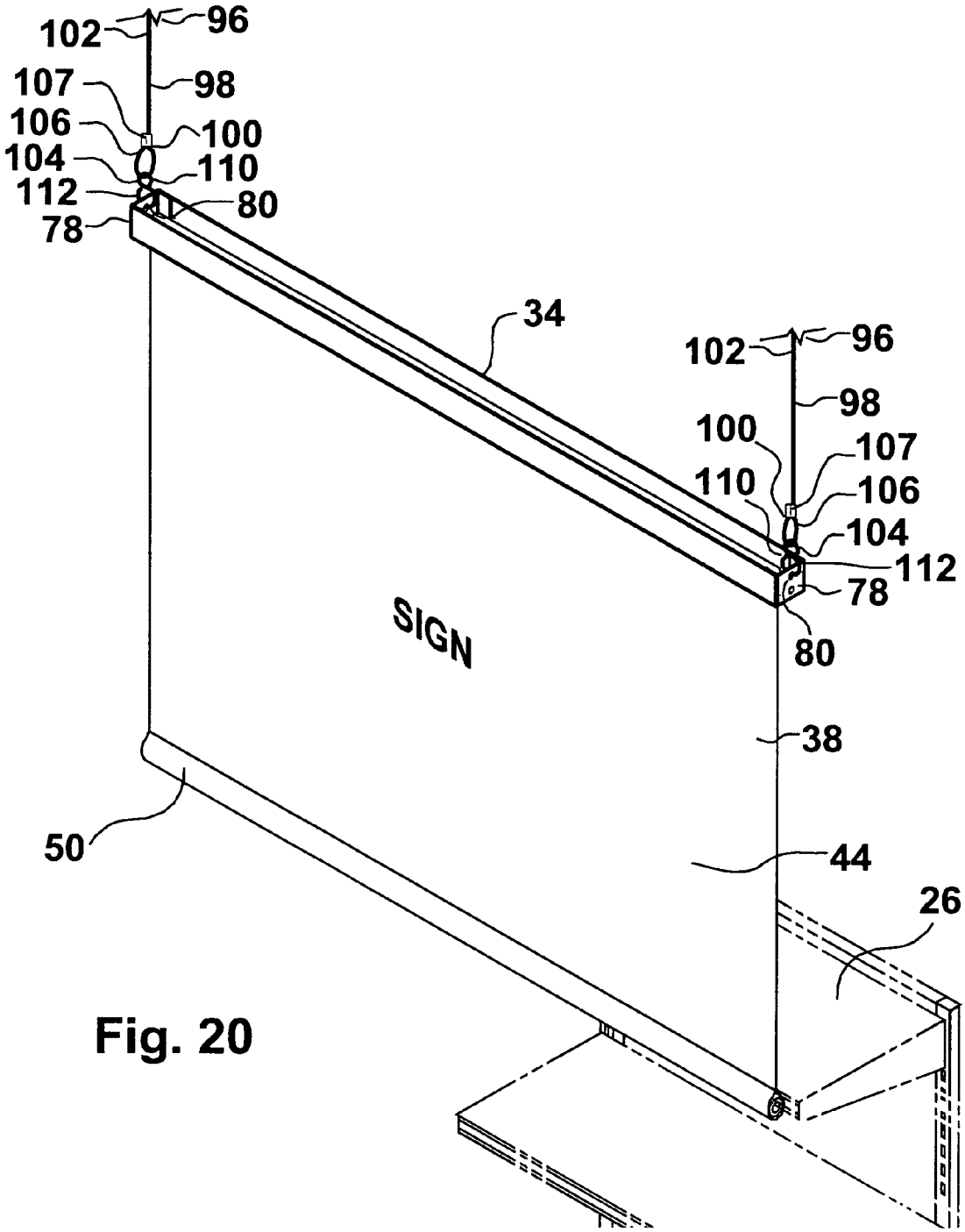

Preferably, the folding sign system 20 of the third embodiment also includes a pair of S-hooks 104. Each of the cable members 98 at the one end 100 thereof include a loop portion 106. The loop portion 106 may be formed by looping one end 100 of cable member 98 back on itself and clamping with a ferrule 107 or compression sleeve, as shown in FIG. 20. The ferrule 107 may be made of aluminum, copper, or steel, for example. The ends 78 of the trough 34 having first apertures 80, as shown in FIG. 20. Each of said S-hook members 104 near the upper portion 110 operatively engaging the loop portion 106 of the cable members 102, and the S-hook member 104 near the lower portion 112 of the S-hook operatively engaging an end 78 of the trough 34 at the first apertures 80. Of course the cable members 98 may be attached by other means. For example, they may be attached to the trough 34 by simply looping the other end 102 of the cable through the first apertures 80 of the trough 34 and securing the loop, not shown.

The preferred embodiments described are by way of example and it is understood that they be modified with out departing from the scope of the present invention.

We claim:

1. A folding sign system for attachment to a shelving system, said shelving system, including vertical hollow uprights proximate the front of said shelving system, and said shelving system including shelving proximate the tops of said vertical uprights, said folding sign system comprising:

at least two vertical supports affixed to and supported by said uprights proximate the tops of said uprights;

at least one elongated trough supported substantially horizontally between said vertical supports proximate the tops of said supports, said trough having a longitudinal slot therein proximate the bottom thereof of predetermined dimensions;

at least one folding sign member carried by said trough, said sign member having a display position with said sign member fully extended and having a shelving accessibility position with said sign member folded;

said folding sign member having a folding media portion sized to pass through said slot and to hang below said trough in said display position;

said folding sign member having an integral top transverse sleeve proximate the top of said sign member;

said folding sign member having an integral bottom transverse sleeve proximate the bottom of said sign member adjacent said media portion;

at least one top elongated member at least partially housed within said top sleeve of said sign member, said top elongated member sized to provide lateral rigidity for said sign member and sized to prevent said top sleeve of said sign member from passing through said slot in said trough with said top elongated member in operative position, said top transverse sleeve housed within said trough;

at least one bottom elongated member at least partially housed within said bottom sleeve of said sign member, said bottom elongated member sized to provide lateral rigidity for said sign member and sized to fit within said trough when said sign member is in said shelving accessibility position, said bottom elongated member of predetermined weight, said bottom sleeve housed within said trough when said sign member is in the shelving accessibility position;

whereby, when said sign member is fully extended in said display position, goods stored on said top shelving are hidden by the media portion of said sign member, and when said sign member is folded in said shelving accessibility position and said bottom sleeve of said sign member is placed in said trough, access is provided to said stored goods on said top shelving.

2. The folding sign system of claim 1, wherein said longitudinal slot of said trough is sized to permit said folding media portion of said sign member to pass freely therethrough.

3. The folding sign system of claim 1, wherein said top elongated member has a minimum cross-sectional width greater than the width of said slot of said trough.

4. The folding sign system of claim 1, wherein said sign system further comprises a plurality of contiguous sign members, said sign members in the display position together having the media portions of said contiguous sign members forming a banner.

5. The folding sign system of claim 1, wherein said folding sign member is comprised of vinyl.

6. The folding sign system of claim 1, wherein said bottom elongated member has a length equal to the width of said sign member.

7. The folding sign system of claim 1, wherein said bottom elongated member has a weight greater than the weight of said sign member, whereby when said sign member is in the shelving accessibility position said weight of said bottom elongated member while resting in said trough maintains said sign member in a folded state.

8. The folding sign system of claim 1, wherein said top elongated member has a length at least as long as the width of said sign member.

9. The folding sign system of claim 1, wherein said slot of said trough is of sufficient width to permit said bottom sleeve of said sign member with said bottom elongated member removed therefrom to pass through said slot.

10. The folding sign system of claim 1, wherein said bottom elongated member and said top elongated member are tubular.

11. The folding sign system of claim 1, wherein said trough further includes a sleeve contact portion having a V-shaped cross-section.

12. The folding sign system of claim 1, wherein said vertical supports proximate the bottoms thereof, each further include an elongated upright insertion portion of predetermined dimensions to wedge snugly within the interior of the tops of said vertical hollow uprights;

whereby said vertical supports are maintained in operative position by said uprights.

13. The folding sign system of claim 12, wherein said elongated upright insertion portion of said vertical supports have a U-shaped cross-section.

14. The folding sign system of claim 12, wherein said vertical supports each further include a lip portion extending about perpendicularly outwardly from said vertical support, said lip portion adjacent to said elongated upright insertion portion of said vertical supports, whereby said lip portion maintains said support in position relative to the tops of said vertical hollow uprights.

15. The folding sign system of claim 1, wherein said tops of said vertical supports each have threaded apertures, therethrough, said trough member proximate the ends thereof having first apertures therein in operative alignment with said threaded apertures of said vertical supports, bolt members passing through said first apertures and operatively engaging said threaded apertures.

16. A folding sign system for attachment to a shelving system, said shelving system including at least one horizontal member proximate the front of said shelving system and shelving mounted below said horizontal member, said folding sign system comprising:

an elongated trough including rearwardly extending tab members affixed thereto, said tab members having openings therethrough, fastener members passing through said openings of said tab members and affixed to said one horizontal member proximate the front of said member, said trough having a longitudinal slot proximate the bottom thereof of predetermined dimensions;

at least one folding sign member carried by said trough, said sign member having a display position with said sign member fully extended and having a shelving accessibility position with said sign member folded;

said folding sign member having a folding media portion sized to pass through said slot and to hang below said trough in said display position;

said folding sign member having an integral top transverse sleeve proximate the top of said sign member, and, said folding sign member having an integral bottom transverse sleeve proximate the bottom of said sign member adjacent said media portion;

at least one top elongated member at least partially housed within said top sleeve of said sign member, said top elongated member sized to provide lateral rigidity for said sign member and sized to prevent said top sleeve of said sign member from passing through said slot in said trough with said top elongated member in operative position, said top transverse sleeve housed within said trough;

at least one bottom elongated member at least partially housed within said bottom sleeve of said sign member, said bottom elongated member sized to provide lateral rigidity to said sign member and sized to fit within said trough when said sign is in said shelving accessibility position, said bottom elongated member of predetermined weight, said bottom transverse sleeve housed within said trough when said sign member is in the shelving accessibility position;

whereby when said sign member is fully extended in said display position, goods stored on shelving below said horizontal member may be hidden by said media portion of said sign member, and when said sign member is folded in said shelving accessibility position and the bottom sleeve of said sign member is placed in said trough, access is provided to said stored goods on said shelving.

17. A folding sign system for hiding goods stored on a shelving system, said folding sign system comprising;

an elongated trough, an overhead anchor member, a pair of cable members, each cable member affixed at one end thereof in supportive relationship with said trough proximate the ends of said trough, said cable members each affixed at the other end thereof to said overhead anchor member, said trough having a longitudinal slot therein proximate the bottom thereof of predetermined dimensions;

at least one folding sign member carried by said trough, said sign member having a display position with said sign member fully extended and having a shelving accessibility position with said sign member folded;

said folding sign member having a folding media portion sized to pass through said slot and to hang below said trough in said display position;

said folding sign member having an integral top transverse sleeve proximate the top of said sign member;

said folding sign member having an integral bottom transverse sleeve proximate the bottom of said sign member adjacent said media portion;

at least one top elongated member at least partially housed within said top sleeve of said sign member, said top elongated member sized to provide lateral rigidity for said sign member and sized to prevent said top sleeve of said sign member from passing through said slot in said trough with said top elongated member in operative position, said top transverse sleeve housed within said trough;

at least one bottom elongated member at least partially housed with said bottom sleeve of said sign member, said bottom elongated member sized to provide lateral rigidity to said sign member and sized to fit within said trough when said sign is in said shelving accessibility position, said bottom elongated member of predetermined weight, said bottom transverse sleeve housed within said trough when said sign member is in the shelving accessibility position;

whereby when said sign member is fully extended in said display position, goods stored on shelving below said trough may be hidden by said media portion of said sign member, and when said sign member is folded in said shelving accessibility position and the bottom sleeve of said sign member is placed in said trough, access is provided to said stored goods on said shelving.

18. The folding sign system of claim 17, further including a pair of S-hook members, each of said cable members at said one end thereof include a loop portion, the ends of said trough having first apertures therethrough;

a first of said S-hook members proximate the upper portion thereof operatively engaging said loop portion of one of said cable members, and said first S-hook member proximate the lower portion thereof operatively engaging one end of said trough proximate one of said first apertures;

a second of said S-hook members proximate the upper portion thereof operatively engaging said loop portion of the other of said cable members, said second S-hook member proximate the lower portion whereof operative engaging the other end of said trough proximate another of said first apertures.

* * * * *